United States Patent [19]

Gorshe

[11] 4,286,746

[45] Sep. 1, 1981

[54] FLEXIBLE POUCH

[75] Inventor: Thomas M. Gorshe, Neenah, Wis.

[73] Assignee: American Can Company, Greenwich, Conn.

[21] Appl. No.: 111,922

[22] Filed: Jan. 14, 1980

[51] Int. Cl.[3] ..... B65D 33/02

[52] U.S. Cl. ..... 229/55; 229/48 T

[58] Field of Search ..... 229/54, 55, 48 T, 62; 206/280, 286, 287; 150/0.5

[56] References Cited

U.S. PATENT DOCUMENTS

| | | | |
|---|---|---|---|
| 3,596,824 | 8/1971 | Lehmacher | 229/54 |
| 4,084,689 | 4/1978 | Yamagata | 229/55 X |
| 4,088,260 | 5/1978 | Stark et al. | 229/55 X |

*Primary Examiner*—George T. Hall

*Attorney, Agent, or Firm*—Robert P. Auber; Thomas D. Wilhelm; Ira S. Dorman

[57] ABSTRACT

A flat pouch is provided with reinforcements along its opening edge adjacent the predetermined locations where sharp corners are desired when the pouch is opened. The reinforcements resist flexing when the pouch is opened, thus ensuring bending of the pouch material, and the formation of sharp corners, at the predetermined locations.

A method is also provided for opening the pouch, which method ensures reliable formation of the required sharp corners in the predetermined locations.

9 Claims, 9 Drawing Figures

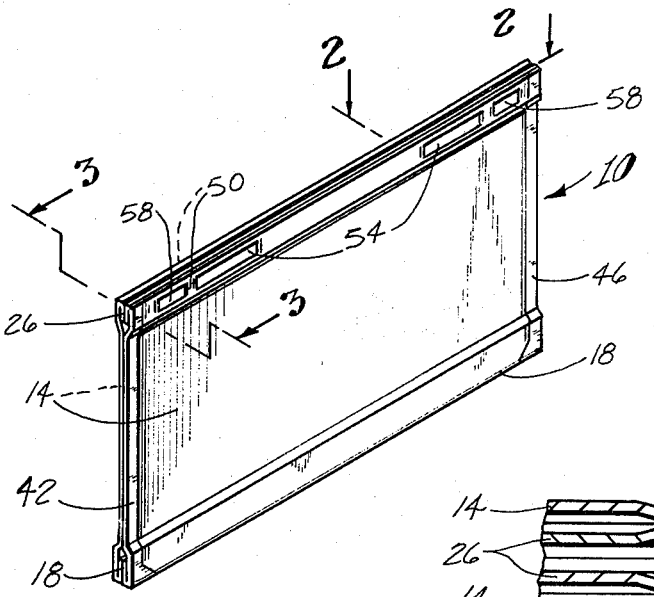
FIG.1
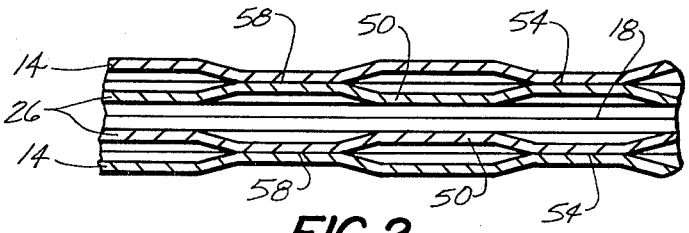
FIG.2
FIG.3
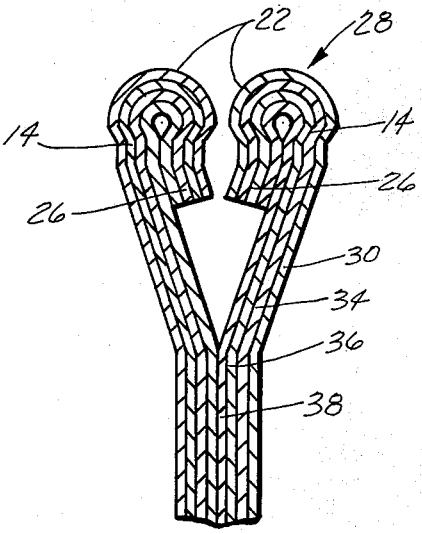
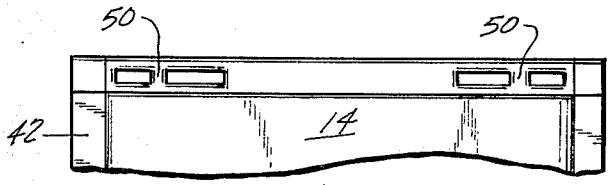
FIG.4
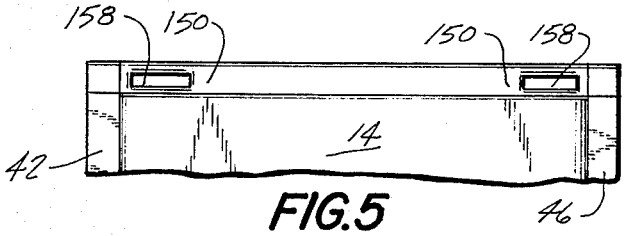
FIG.5
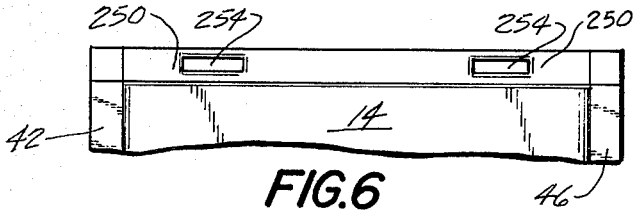
FIG.6

FLEXIBLE POUCH

BACKGROUND OF THE INVENTION

This invention relates to a flexible pouch such as is used in the packaging of processed cheese, and to a method of opening it for inserting product. Such pouches are generally opened by gripping the top margin of each side of the pouch with vacuum means and pulling the sides away from each other. The vacuum means grips the flat pouch at four locations which are intended to form the four corners of the rectangularly-shaped open pouch. After the pouch is opened on its top margin, a ram descends into the pouch from the top, completely opening and shaping the pouch to its full designed volume and shape. In some instances, the top margin of the pouch is not opened properly by the vacuum means, such that the margin is improperly formed into some shape other than a rectangle having four straight edges. The improperly formed margin may then be impacted by the descending ram, and pushed ahead of the ram, such that the pouch is at least partially crumpled by the ram. Such improperly formed pouches cannot be used, and thus must be discarded as waste. Further, the flow of packaged product from the packaging operation is interrupted, incurring all the costs associated with such failures.

Apparatus has been developed for assisting in consistently forming sharp-cornered rectangles in the top margin of the pouch. For example U.S. Pat. No. 4,150,519 teaches suction cup apparatus specifically designed to assist in location and forming of the corners. Copending application Ser. No. 081,528 filed Oct. 3, 1979, shows a suction box modified to control the gripping of the pouch.

It is an object of this invention to provide an improved pouch which can be reliably formed into a rectangular receptacle having on its open margin sharp corners at predetermined locations.

It is a further object to provide a method for opening the pouch, the method ensuring that the top margin of the pouch will conform to the required shape when it is opened.

SUMMARY OF THE INVENTION

It has now been found that certain of the foregoing and related objects may be achieved in an improved, substantially flat pouch made with flexible sheet material, and susceptible of being opened into a receptacle, the pouch having a pair of opposed side wall panels joined to each other about the periphery thereof, and having a pair of opposed unjoined margins along one edge of the periphery. The combination of the joined side wall panels and the unjoined margins form a receptacle capable of receiving and holding product. The margins have predetermined locations thereon for the forming of sharp corners when the pouch is opened, and the margins have reinforcement adjacent each predetermined location, whereby the margins are stiffened and rendered more resistant to flexing in the reinforced areas relative to the predetermined locations.

In a preferred embodiment, a strip of the sheet material is folded over onto the interior surface of the pouch side wall along the locus of the one edge of the periphery to form a lip, the lips and the contiguous facing side walls comprising the margins. The reinforcement is provided by affixation of each lip to its contiguous facing side wall adjacent each predetermined location. The facing surfaces of the lips and the side walls along each margin may be heat sealable to each other, and thus the affixation may be provided by heat seals between the facing surfaces.

In one embodiment, the margin on each side wall has a pair of predetermined locations, the predetermined locations being interposed between the reinforcements.

In another embodiment, the reinforcements on each margin are interposed between the predetermined locations.

In yet another embodiment, reinforcement is provided on each side of the predetermined locations.

The invention further contemplates a method of opening the pouch and forming sharp corners at the predetermined locations, the method comprising the steps of providing reinforcement to the margins adjacent the predetermined locations whereby the margins are stiffened and rendered more resistant to flexing in the reinforced areas relative to the predetermined locations, and moving each predetermined location away from the corresponding opposing juxtaposed margin to thereby open the pouch.

BRIEF DESCRIPTION OF THE DRAWINGS

FIG. 1 is a perspective view of a pouch used in this invention showing heat seal reinforcements adjacent the predetermined corner locations.

FIG. 2 is an enlarged fragmentary cross-section taken at 2—2 in FIG. 1, looking in the direction of the arrows, and showing the relationship of the heat seals to a predetermined location on the pouch margin.

FIG. 3 is an enlarged fragmentary cross-section taken at 3—3 in FIG. 1, looking in the direction of the arrows, and showing the double layer of pouch material on each side of the pouch at the opening margin.

FIGS. 4, 5, and 6 are fragmentary side views of the opening margin of the pouch showing heat seal reinforcements in three alternate embodiments of the pouch.

DETAILED DESCRIPTION OF THE PREFERRED EMBODIMENT

Figure 7:
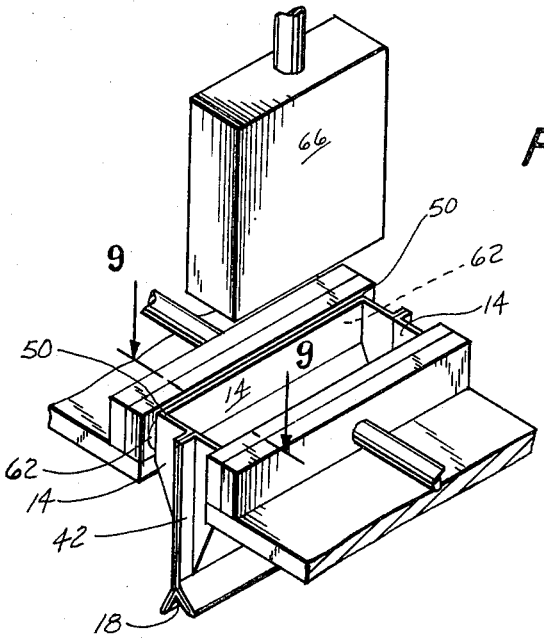
FIGS. 7 and 8 are perspective showings of a pouch being operated on by portions of a pouch opening apparatus useful with this invention.

A pouch is shown generally as 10 in FIG. 1. The pouch 10 has two facing side walls 14 which meet generally in a contiguous gusseted bottom 18. A strip of each side wall 14 is turned inwardly at its upper edge and folded against itself to form a margin 28 composed of a lip 26 formed from the strip and the upper portion of side wall 14, as shown in FIG. 3. Each side wall is composed of an outer layer 30, a barrier layer 34, a stability layer 36, and an inner layer 38. Outer layer 30 is generally situated on the exterior of the pouch and must be capable of withstanding the external abuse to which the pouch may be subjected. A preferred material for layer 30 is varnish. Barrier layer 34 is desirably a layer which provides special barrier properties, for protecting the contained product from the external environment. A typical material used for layer 34 is aluminum foil. Other typical barrier materials are ethylene vinyl alcohol copolymers and Saran (polyvinyl chloride/polyvinylidene chloride). Stability layer 36 is optional in the structure. This material is normally chosen for its biaxial stability, and ability to resist stretching. A preferred material is mylar, a biaxially oriented polyester sold by the duPont Company. Inner layer 38 is heat sealable material such as low density polyethylene or ethylene vinyl acetate.

The method of constructing the composite sheet structure shown in FIG. 3 is generally known to one skilled in the art of flexible packaging. For example, a film of 48 gauge mylar may be adhesively mounted to one side of 32 gauge foil using a curing type polyester adhesive. The opposite surface of the aluminum foil may then be decorated, such as by printing with ink, and the entire foil surface coated with varnish. In the final step of constructing the sheet structure, a layer of heat sealable ethylene vinyl acetate copolymer is then extrusion coated onto the mylar, and the ethylene vinyl acetate is lightly dusted with starch to prevent inadvertent blocking of the heat seal coating.

While one composite sheet structure and its method of construction have been described, it should be appreciated that no specific sheet structure is critical to the invention, and a wide variety of sheet materials may be adapted for use herein. For example, the pouch sheet material may be as simple as a single layer of low density polyethylene if the required reinforcements are applied as hereinafter described. Likewise, the sheet material may be a sophisticated structure, of the user's own choosing.

The general process of making the pouch from the composite sheet structure shown is also generally known. A length of the sheet is folded over onto itself forming two facing side wall panels 14, the two side wall panels 14 being joined together by a gusseted fold line, with layer 38 on the inside of the structure, and layer 30 on the outside of the structure. A strip 26 of the sheet material on the edge of each panel of the sheet structure farthest from the gusseted fold line is then folded over onto the corresponding panel, with the heat seal layer 38 to the inside of the fold, to form a lip. Formation of the pouch is then completed by heat sealing the two facing side wall panels to each other along pouch edges 42 and 46, completely sealing the pouch edges, from the bottom of the pouch 18 to substantially the bottom edge of lips 26. In the formation of the heat seals, it is normal practice to drive the sealing heat through layers 30, 34, and 36 to effect softening of layer 38. In order to retain the package structural integrity, and to facilitate the heat sealing operations, layers 30, 34 and 36 must be able to withstand the heat which is driven through them in the heat sealing process, without being damaged. The top edges 22 of the pouch and the tops of the side wall panels 14 are intentionally not sealed together at this point of manufacture. Neither are lips 26 sealed to each other. However, heat seals 54 and 58, as hereinafter discussed, may be formed at this time.

Locations 50 are predetermined locations at the top margin of each side wall 14 where it is desired that sharp corners be formed when the pouch is opened. Heat seals 54 and 58 are formed on each side of, and adjacent, each predetermined location 50, there being two such locations on each side wall as indicated in FIGS. 1 and 4. Thus a heat seal 58 is disposed between a location 50 and edge 42 of the pouch; and another heat seal 54 is disposed on the side of the location 50 away from edge 42. As shown in FIGS. 2 and 3, heat seals 54 and 58 are each formed between a side wall 14 and a lip 26.

The affect of the heat seals 54 and 58 is that of forcing the lip material and the side wall material to act cooperatively together in resisting forces which would tend to cause the sheet material to bend in that location, 54 or 58, which is adjacent a predetermined location 50.

The pouch is opened for filling, and subsequent sealing, by grasping the top portion of the pouch with a vacuum device 62 at each predetermined location, and moving the locations 50 away from the corresponding opposing margins as shown in FIG. 7. In the process of opening the pouch, forces are applied by means of the vacuum at predetermined locations 50. Since, in commercial applications the nominal force distribution in the pouch margin 28 varies from pouch to pouch, the corners of a given pouch may have a tendency to form at areas 54 or 58 rather than at predetermined locations 50; thus causing the problem of the top edge 22 of the pouch being impacted by the ram, as discussed earlier. Since the top margins 28 of the pouch have been effectively reinforced by the heat seals at locations 54 and 58, the top margin is least susceptible to bending at 54 and 58, and resists bending at those locations more than it resists bending at predetermined locations 50. Thus the locations most susceptible to bending, in the areas of force application, are predetermined locations 50; and the margins do bend at those locations, forming the desired sharp corners. As the locations 50 are moved away from their corresponding opposing margins, the pouch margins form an angle about each location 50, with the angle becoming a right angle in the fully opened pouch as shown in FIGS. 7 and 9.

Figure 8:
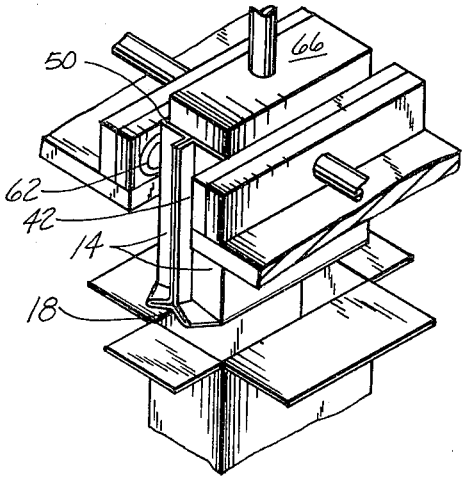

As shown in FIG. 7, the vacuum device opens the pouch only at the top. FIGS. 7 and 8 show that the ram 66 is critically sized to maximize the ram cross-section while still being able to enter the top-opened pouch shown in FIG. 7, thus ensuring that the pouch is fully opened into the designed shape by the ram. Namely, only a small clearance exists between ram 66 and the pouch side walls 14 as it enters the pouch. Clearly, any deviation of the pouch from the rectangular shape shown in FIG. 7 will interfere with satisfactory operation of ram 66. The forming of the pouch in preparation for receiving product is completed by moving ram 66 down into the pouch, thus forcing it open into the designed shape as shown in FIG. 8.

Figure 9:
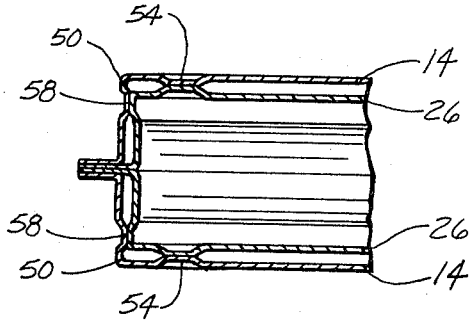
FIG. 9 is a fragmentary cross-section taken at 9—9 of FIG. 7 and showing the relationship of the heat seals to the predetermined locations after the pouch is opened.

The completely opened pouch is best shown in FIG. 9. Sharp corners are formed at predetermined locations 50, flanked on either side by heat seals 54 and 58 on margin 28, the seals being formed between lips 26 and contiguous side walls 14. The opened pouch is then passed along the packaging line where it is filled with product and closed by forming heat seals along the top of side walls 14 and under margins 28, to completely seal the pouch.

While in the preferred embodiment described above, heat seals are located on both sides of each predetermined location, it has been observed that the tendency of the top margin of the pouch to flex and form corners at the predetermined location is substantially enhanced by the use of a heat seal on only one side of each predetermined location when used in combination with the step of moving the predetermined locations 50 away from the opposing margins. Thus the advantages discovered in this invention may be obtained by using heat seals 158 only between and adjacent the predetermined locations 150 and the edge of the pouch as shown in FIG. 5. In this embodiment predetermined locations 150 are disposed between heat seals 158. Similarly the heat seals 254 may be located only between, and adjacent, the predetermined locations 250 as shown in FIG. 6.

Thus it is seen that this invention provides an improved pouch which can be reliably formed into a rectangular receptacle having on its open margin sharp corners at predetermined locations. It is also seen that a method is provided for opening the pouch, the method ensuring that the top margin of the pouch will conform to the required shape when it is opened.

Having thus described the invention, what is claimed is:

1. A substantially flat pouch made with flexible sheet material, and susceptible of being opened into a receptacle, said pouch comprising: a pair of opposed side wall panels joined to each other about the periphery thereof, and having a pair of opposed unjoined margins along one edge of the periphery, the combination of said joined side wall panels and said unjoined margins forming a receptacle capable of receiving and holding product; said margins having predetermined locations thereon for the forming of sharp corners when the pouch is opened, and said margins having reinforcement thereof adjacent each said predetermined location, whereby said margins are stiffened and rendered more resistant to flexing in said reinforced areas relative to said predetermined locations.

2. A pouch as in claim 1 wherein a strip of said sheet material is folded over onto the interior surface of the pouch side wall along the locus of said one edge of said periphery to form a lip, said lips and the contiguous facing side walls comprising said margins, said reinforcements being provided by affixation of each said lip to its contiguous facing side wall adjacent each said predetermined location.

3. A pouch as in claim 2 wherein the facing surfaces of said lips and said side walls along each said margin are heat sealable to each other, and wherein said affixation is provided by heat seals between said facing surfaces.

4. A pouch as in claim 1, 2, or 3 wherein said margin on each said side wall has a pair of said predetermined locations and wherein said predetermined locations on each said margin are interposed between the corresponding reinforcements on each said margin.

5. A pouch as in claim 1, 2, or 3 wherein said margin on each said side wall has a pair of said predetermined locations and wherein said reinforcements on each said margin are interposed between the corresponding predetermined locations on each said margin.

6. A pouch as in claim 1, 2, or 3, said margins having reinforcement on each side of said predetermined locations.

7. In the process of opening a substantially flat pouch made with flexible sheet material, the pouch having a pair of opposed side wall panels joined to each other about the periphery thereof, and having a pair of opposed unjoined margins along one edge of said periphery, the combination of said joined side wall panels and said unjoined margins forming a receptacle capable of receiving and holding product; a method of forming sharp corners at predetermined locations on said margins comprising the steps of: providing reinforcement to said margins adjacent said predetermined locations whereby said margins are stiffened and rendered more resistant to flexing in the reinforced areas relative to said predetermined locations; and moving each said predetermined location away from the corresponding opposing margin to thereby open the pouch, whereby said margins flex about said predetermined locations to form sharp corners in the opened pouch.

8. A method as in claim 7 wherein a strip of said sheet material is folded over onto the interior surface of the pouch side wall along the locus of said one edge of said periphery to form a lip, said lips and the contiguous facing side walls comprising said margins, said reinforcements being effected by affixation of each said lip to its contiguous facing side wall adjacent each said predetermined location.

9. A method as in claim 8 wherein said facing surfaces of said lips and said side walls along each said margin are heat sealable each to the other, and wherein said affixation is provided by heat seals between said facing surfaces.

* * * * *